United States Patent [19]

Nohe et al.

[11] 3,969,200

[45] July 13, 1976

[54] MANUFACTURE OF PROPIOLIC ACID

[75] Inventors: Heinz Nohe, Meckenheim; Peter Jaeger, Ludwigshafen, both of Germany; BASF Aktiengesellschaft, 03, Ludwigshafen, Rhine, Germany

[73] Assignee: BASF Aktiengesellschaft, Ludwigshafen (Rhine), Germany

[22] Filed: Feb. 14, 1975

[21] Appl. No.: 549,912

[30] Foreign Application Priority Data

Feb. 26, 1974 Germany.....2409117

[52] U.S. Cl...... 204/79; 204/78; 204/72

[51] Int. Cl.[2]..... C25B 3/02; C25B 11/10; C25B 11/16

[58] Field of Search..... 204/72, 78, 79

[56] References Cited

FOREIGN PATENTS OR APPLICATIONS

| | | | |
|---|---|---|---|
| 2,133,729 | 12/1972 | France | 204/290 F |
| 937,048 | 12/1955 | Germany | 204/79 |

*Primary Examiner*—F.C. Edmundson

*Attorney, Agent, or Firm*—Johnston, Keil, Thompson & Shurtleff

[57] ABSTRACT

Production of propiolic acid by anodic oxidation of propargyl alcohol in aqueous sulfuric acid solution, using lead dioxide/titanium composite electrodes as anodes and extracting the propiolic acid from the electrolyte with an ether which contains more than one ether oxygen atom and boils above propiolic acid.

7 Claims, No Drawings

MANUFACTURE OF PROPIOLIC ACID

The invention relates to a new advantageous process for the manufacture of propiolic acid by electrolytic oxidation of propargyl alcohol.

German 931,409 discloses the manufacture of propiolic acid by anodic oxidation of propargyl alcohol in sulfuric acid solution, using lead anodes. It is advantageous to carry out this process in a compartmented cell in which the anode chamber and cathode chamber are separated by a diaphragm. The anode consists of a lead tube of flat coils, whilst the cathode may consist of copper or other suitable metals. If platinum is used as the cathode material, a diaphragm is not needed.

When this process is carried out industrially, the lead dioxide layer of the lead, which is used in the form of tubes or sheets, proves unstable, especially under electrolysis conditions, where fairly high current densities are used. For instance, the smooth lead surface covered with lead dioxide suffers erosion in time due to the lead dioxide's flaking off and dissolving. After prolonged operation, erosion causes destruction of the electrode, both in batchwise operation with batch changes, and in continuous operation. Furthermore, the lead dioxide dissolved off also rapidly destroys the ion exchange membranes which are conventionally used as diaphragms, so that the anode and the membrane have to be changed frequently.

To isolate the propiolic acid, formed by electrolysis, from the electrolyte containing sulfuric acid, the conventional process uses salting out with sodium chloride and extraction with diethyl ether. The addition of sodium chloride makes it impossible to use the aqueous electrolyte for further electrolysis, and it must subsequently be discarded. This, on the one hand, entails the loss of valuable chemicals, and, on the other, produces materials which cause environmental pollution. The use of diethyl ether for extraction suffers, inter alia, from the further disadvantage that substantial amounts of water are dissolved and must be removed to obtain pure propiolic acid. Finally, to obtain the pure acid from the ether, the amounts of solvent which have to be distilled and recondensed are several times the amount of propiolic acid.

Because of these disadvantages, the above process for the manufacture of propiolic acid by electrolytic oxidation of propargyl alcohol has not found acceptance in industry.

We have found that these disadvantages in the manufacture of propiolic acid by anodic oxidation of propargyl alcohol in aqueous sulfuric acid solution are avoided by using one or more lead dioxide/titanium composite electrodes as anodes and extracting the propiolic acid from the aqueous sulfuric acid electrolyte with an ether which contains more than one ether oxygen atom and boils above propiolic acid.

The anodes used in the process according to the invention are lead dioxide/titanium composite electrodes, such as are described, e.g., in German Laid-Open Applications 2,119,570 and 2,344,645. Since industrial use of the conventional method of electrolytic oxidation of propargyl alcohol was hampered, inter alia, by the instability of the lead dioxide anodes, it is surprising that industrial-scale anodic oxidation on lead dioxide/titanium composite electrodes is trouble-free. No significant loss of electrode material is observed. Lead dioxide/titanium composite electrodes are dimensionally stable for long periods under the conditions of propiolic acid synthesis so that the process according to the invention can be carried out with narrow electrolyte chambers, for example chambers in which the cation exchanger membrane which forms the diaphragm is brought as close as 50 mm to 0.01 mm to the anode, giving attractive space-time yields and low energy consumption for electrolysis and for cooling.

Electrolysis itself is carried out under conventional conditions. It is expedient to start electrolysis with a propargyl alcohol concentration of about from 2 to 12% by weight in the anolyte. Although lower or higher concentrations can be used they require unnecessarily large electrolysis equipment or adversely affect the yield of product. The concentration of sulfuric acid can be varied within wide limits though higher concentrations than 30% by weight offer no advantages. The balance to 100% is generally water since it is not necessary to add organic solvents, but the anolyte recycled from the extraction can contain, up to the saturation limit, the ether used as the extractant.

The current density used is advantageously up to about 25 A/dm$^2$ of geometrical anode surface, since substantially higher current densities give poorer yields of product. The reaction temperature should advantageously not exceed about 35°C since above approx. 40°C increased flocculation occurs in the anolyte, accompanied by a reduction in yield.

The polyfunctional ethers boiling above propiolic acid which are used for the extraction of the sulfuric acid electrolyte are preferably straight-chain aliphatic ethers with three ether oxygen atoms, such as diethylene glycol dibutyl ether, diethylene glycol butyl amyl ether, diethylene glycol propyl amyl ether or diethyl diethylene glycol diamyl ether. Mixtures of these ethers can also be used.

When using these ethers, it is not necessary either to salt out the aqueous electrolyte or to dry the ether phase. Furthermore, the extracted electrolyte can be reused repeatedly. In addition, the propiolic acid can easily be isolated from the extract by vacuum distillation, which first gives an aqueous mixture and then the pure propiolic acid. Water can also be removed beforehand, if desired, by azeotropic distillation with benzene. Residual solvent can — if necessary, after purification — be re-used for extraction.

The extraction conditions can be varied within wide limits, but for practical reasons certain ranges of amount of solvent and of temperature are preferred. The weight ratio of solvent to electrolyte is advantageously from 1 : 20 to 10 : 1. The deciding factor is the completeness with which it is desired to remove the propiolic acid from the electrolyte. A weight ratio of from 1 : 5 to 1 : 1 is preferred.

Extraction is preferably carried out at from 0° to 50°C. Though lower temperatures are not detrimental, they entail extra cost and provide no advantages. At temperatures above 50°C, the relative solubilities in most cases become less favorable, but in particular by-products are increasingly formed. The process is preferably carried out at room temperature.

EXAMPLE

The electrolysis apparatus comprises a compartmented electrolysis cell, stock vessel, heat exchanger and circulating pump for the anolyte. The catholyte is merely stirred by cathodic evolution of gas. The cell itself comprises the anode, anode frame, diaphragm, cathode frame and cathode, assembled similarly to a filter press. Such filter press cells are described by H. Suter in " Phthalsaureanhydrid und seine Verwendung," Steinkopff-Verlag, Darmstadt, 1972. The anode is a sheet of titanium to which is electrically spotwelded a lead dioxide/titanium composite electrode, which has been produced by the process described in German Laid-Open Application 2,344,645, using a titanium carbide base and an expanded titanium metal body. The dimensions of the expanded titanium metal body are about 10 × 20 cm. The anode frame is made of polyethylene and has two holes on each of its narrow sides, through which the anolyte enters and leaves. The diaphragm, based on sulfonated polytetrafluoroethylene, is held by about 2 mm thick polypropylene nets so that the mean distance between the anode and diaphragm, and between the cathode and diaphragm, is about 2 mm in each case. The cathode frame is similar to the anode frame. The cathode is made of copper.

A mixture of 1,000 parts of water, 190 parts of sulfuric acid and 50 parts of propargyl alcohol is oxidized anodically in this electrolysis apparatus. At 25°C the cell voltage is 2.9 V at a current density of 10 A/dm$^2$, and 3.3 V at 20 A/dm$^2$. The weight loss of the anode during electrolysis due to erosion of lead dioxide is less than 1 mg/ampere hour at a current a density of 100 A/dm$^2$, and is typically about 0.1 mg/ampere hour.

The anolyte (19,100 parts), which was obtained by electrolysis of a mixture of 800 parts of propargyl alcohol, 3,040 parts of sulfuric acid and 16,000 parts of water, contains 720 parts of propiolic acid, as determined by titration. The anolyte is extracted at room temperature in a pulsating column using 9,500 parts of diethylene glycol dibutyl ether. The entire ether phase contains 685 parts of propiolic acid. Distillation at 8 ± 3 mm Hg first gives 250 parts of a fraction consisting essentially of water, followed by 630 parts of propiolic acid of from 94 to 96% strength. 60 parts of propiolic acid are left in the bottoms.

What we claim is:

1. A process for the manufacture of propiolic acid by anodic oxidation of propargyl alcohol in aqueous sulfuric acid solution at a temperature not exceeding 40°C, wherein one or more lead dioxide/titanium composite electrodes are used as anodes and the propiolic acid is extracted from the aqueous sulfuric acid electrolyte with a straight-chain aliphatic ether which contains three oxygen atoms and boils above propiolic acid.

2. A process as set forth in claim 1, wherein the extraction is carried out with diethylene glycol dibutyl ether.

3. A process as set forth in claim 1, wherein the aqueous sulfuric acid solution of propargyl alcohol used as the electrolyte contains from 2 to 12 per cent by weight of propargyl alcohol and up to 30 per cent by weight of sulfuric acid.

4. A process as set forth in claim 1, wherein the oxidation is carried out at a temperature which does not exceed 35°C.

5. A process as set forth in claim 1, wherein a weight ratio of ether solvent to aqueous sulfuric acid electrolyte is from 1 : 20 to 10 : 1.

6. A process as set forth in claim 1, wherein the extraction is carried out at a temperature of from 10° to 50°C.

7. A process as set forth in claim 1, wherein the extracted electrolyte is reused.

* * * * *